United States Patent [19]

Horbelt et al.

[11] Patent Number: 4,487,189

[45] Date of Patent: Dec. 11, 1984

[54] CONTROL MECHANISM FOR FUEL METERING OF A COMBUSTION ENGINE

[75] Inventors: Michael Horbelt, Schieberdingen; Herbert Arnold, Eberdingen, both of Fed. Rep. of Germany

[73] Assignee: Robert Bosch GmbH, Stuttgart, Fed. Rep. of Germany

[21] Appl. No.: 477,783

[22] Filed: Mar. 22, 1983

Related U.S. Application Data

[63] Continuation of Ser. No. 247,026, Mar. 24, 1981, abandoned.

[30] Foreign Application Priority Data

Mar. 26, 1980 [DE] Fed. Rep. of Germany ..... 3011638

[51] Int. Cl.[3] ..... F02B 3/00

[52] U.S. Cl. ..... 123/491; 123/488

[58] Field of Search ..... 123/179 L, 491, 339, 123/340, 488, 494, 478, 418

[56] References Cited

U.S. PATENT DOCUMENTS

| | | | |
|---|---|---|---|
| 3,971,354 | 7/1976 | Luchaw et al. | 123/179 L |
| 4,134,368 | 1/1979 | Hadley | 123/491 |
| 4,148,282 | 4/1979 | Grassle et al. | 123/179 L |
| 4,208,991 | 6/1980 | Reddy | 123/418 |
| 4,227,491 | 10/1980 | Schnürle et al. | 123/488 |
| 4,246,639 | 1/1981 | Carp et al. | 123/431 |
| 4,327,691 | 5/1982 | Moser | 123/179 L |
| 4,335,687 | 6/1982 | Sugasawa et al. | 123/179 L |

*Primary Examiner*—Raymond A. Nelli

*Attorney, Agent, or Firm*—Edwin E. Greigg

[57] ABSTRACT

A control mechanism for a fuel metering system in a combustion engine is proposed which makes possible a start control defined as load-independent or as nearly load-independent. It is the purpose of the control mechanism to avoid possible false interpretations of the load signal during extremely low rpm. The control mechanism comprises a function generator which, dependent on operational characteristics, determines or co-determines the signal at the load input of a signal processing stage of the fuel metering apparatus during start-up.

8 Claims, 3 Drawing Figures

CONTROL MECHANISM FOR FUEL METERING OF A COMBUSTION ENGINE

This is a continuation of application Ser. No. 247,026, filed Mar. 24, 1981, now abandoned.

BACKGROUND OF THE INVENTION

The invention is based on a control mechanism for a fuel metering system of a combustion engine of the general type described hereinafter. Amongst others, a fuel injection system is known in which the control mechanism creates injection impulses based on rpm or load signals. In this known system a switch is coupled with the throttle plate mechanism signaling the idling or overrunning of the combustion engine. While this fuel injection system does not pose any problems during normal operation, a correct operation during start-up and immediately thereafter cannot always be achieved. This is because at the beginning of the ignition process a fixed injection inpulse time is programmed in, but a change is made, after even a minor deflection of the air metering plate, to the normal injection time based on load and rpm signals. Considering the initially very small rpm values during the first deflection of the air metering plate a comparatively very high value of load is simulated and therefore a very large amount of fuel is supplied. In such as case instead of the combustion engine starting up and running smoothly, it will gradually die and have to be restarted.

OBJECT AND SUMMARY OF THE INVENTION

The control mechanism in accordance with the present invention has the advantage that the signals from the air metering device are not wrongly interpreted in the end during the start-up procedure and therefore no incorrect fuel metering takes place.

In this connection it is important to realize that the control mechanism in accordance with the present invention is not limited to a specific fuel metering system, but that it controls fuel metering in general during the engine start-up procedure.

The invention will be better understood and further objects and advantages thereof will become more apparent from the ensuring detailed description of preferred embodiments taken in conjunction with the drawings.

BRIEF DESCRIPTION OF THE DRAWINGS

Exemplary embodiments of the present invention are shown in the drawings and further described in the following description.

DESCRIPTION OF THE PREFERRED EMBODIMENTS

Figure 1:
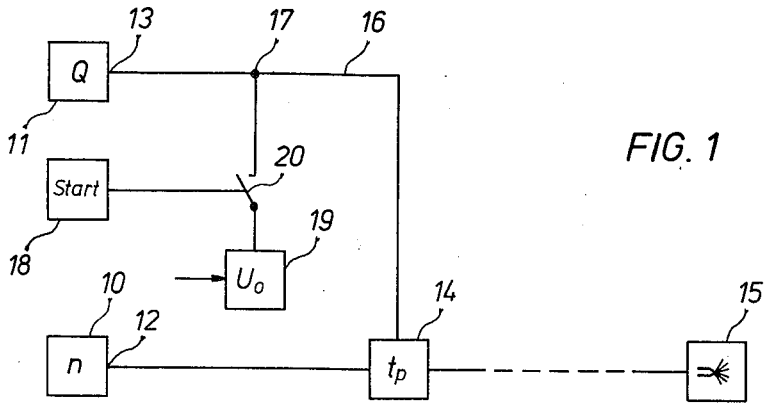
FIG. 1 shows a general block circuit diagram of a fuel injection apparatus.

FIG. 1 shows a general block circuit diagram of the control mechanism of an intermittently operating fuel metering system with its essential sensors. These are an rpm counter 10 as well as an air mass or air volume meter 11, the exits 12 and 13 of which are coupled with a triggering device such as a pulse generator 14, which of itself as well-known and is disclosed as a timing element 14 in U.S. Pat. No. 4,275,695. In turn, this pulse generator 14 is connected—if necessary via correction and amplifier stages not shown—with at least one injection nozzle 15. A connecting line 16 between the exit 13 of the air mass meter 11 and the pulse generator 14 has a coupling point 17, to which the initial signal of a function generator 19 can be switched via a switch 20, based on the initial signal of the start-up switch 18 or starting signal transducer, which in the simplest case would be that operated by a driver.

In the apparatus according to the present invention, the switch 20 remains closed during the start-up procedure and switches the initial signal of the function generator 19 to the coupling point 17 and thereby to the load inlet of the pulse generator 14. It is necessary to ascertain that the initial signal of the function generator 19 is dominant over the intitial signal of the air mass or air volume meter 11. Thus, during the start-up process, injection signals are formed in the pulse generator 14 which are dependent on the rpm and on the initial signal of the function generator 19 and which are passed on to the injection nozzles 15.

The initial signal of the function generator 19, of course, has to be adjusted to the respective type of combustion engine as well as to the respective pulse member generator 14. In the simplest case this function generator 19 emits a constant potential. After all, it is possible to envision voltage processes in the function generator 19 dependent on time and/or temperature and/or rpm loads.

Figure 2:
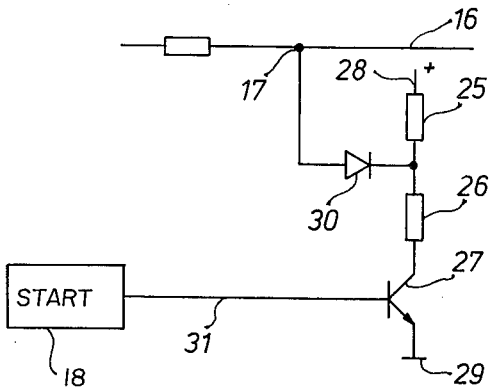
FIG. 2 shows a first example of a circuit diagram for a start-up control independent of the load.

A very simple example of a function generator 19 has the circuit arrangement shown in FIG. 2. There the function generator comprises a potentiometer made up of two resistors 25 and 26 which are placed in series between a transistor 27 and two operating voltage connectors 28 and 29. The connecting point of the two resistors 25 and 26 is connected with the coupling point 17 via a diode 30. The transistor 27 corresponding to switch 20, shown in FIG. 1, is controlled by the start-up switch 18 via a line 31 on the base side.

In case of a positive signal in line 31 the transistor 27 makes a connection. Based on the flow of currency now occurring through the two resistors 25 and 26, the potential at their connecting point is decreased and this potential is now also present, via the diode 30, at the coupling point 17 and the load inlet of the pulse generator 14. Thus, as long as there is a positive signal in line 31, corresponding to the length of the start-up procedure, the air mass measuring signal from the respective sensor 11 does not operate in the first place for sustaining the load and fuel is metered to the combustion engine independently of the load at the time.

Preferably the ratio of resistance of the two resistors 25 and 26 is chosen in such a way that the voltage at the coupling point 17 does not rise at all or only insignificantly as compared with the operation at idle, even when the initial signal of the air mass meter 11 increases because of higher air content.

Figure 3:
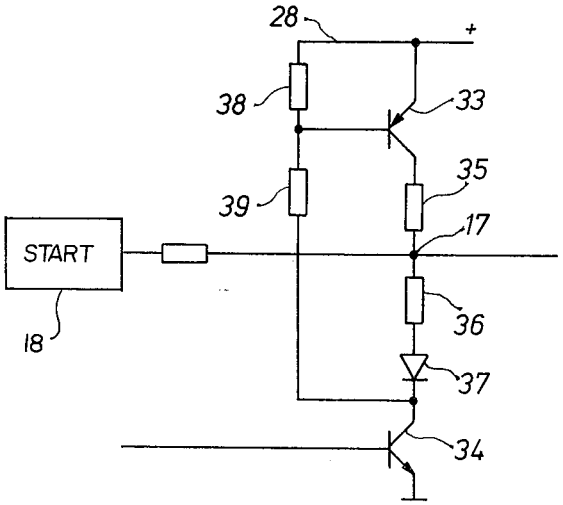
FIG. 3 shows a second examplary embodiment.

FIG. 3 shows a circuit arrangement which permits the placing of a predetermined voltage at coupling point 17. For this purpose this coupling point 17 is included in an in-series arrangement of two resistors 35 and 36 as well as a diode 35 between resistor 36 and transistor 34. While the base of the transistor 34, corresponding to the switch 20, shown in FIG. 1, again receives a signal from the start-up switch 18, the base of the transistor 33 is connected via a first resistor 38 with the positive line 28 and via a further resistor 39 with the connecting point between diode 37 and transistor 34.

With this arrangement a constant potential level is achieved at the coupling point 17 as soon as the transistor 34 is switched in and thereby permits the start-up procedure to take place. In this case the signal at coupling point 17 is totally independent of output of the air mass measuring member 11.

It is important to know in connection with the circuit arrangements described above that during the start-up procedure the fuel metering takes place independently of or, in a defined way, nearly independently of a load signal. In this manner irregularities in the metering of the mixture during the start-up operation are corrected, especially in problematical cases, which leads firstly to a clean exhaust gas and secondly to a problem-free start-up of the combustion engine.

The examples cited simply demonstrate the essence of the invention. In particular, it would be apparent that, for instance, the switch 20 could form a functional unit with the function generator 19 or that the function generator 19 per se might have several possibilities for influencing the rpm or the temperature, for instance.

Further, it is possible to envision a double-throw switch instead of a coupling point in order to alternatively switch the load input of the pulse generator 14 to the air mass meter or the function generator.

The foregoing relates to preferred exemplary embodiments of the invention, it being understood that other embodiments and variants thereof are possible within the spirit and the scope of the invention, the latter being defined by the appended claims.

What is claimed and desired to be secured by Letters Patent of the United States is:

1. A control system for a fuel metering system of an internal combustion engine having a pulse generator to which load and rpm signals are supplied from an rpm sensor and a load sensor for forming an injection signal, a function generator for simulating a load signal, and a switching means responsive to a start-up operation for coupling said function generator to the load signal input of said pulse generator, whereby said simulated load signal from said function generator can be coupled to said signal from said load sensor.

2. A control system as defined in claim 1, wherein the function generator determines the signal at the load input of said pulse generator during a starting operation until a predetermined rpm has been reached.

3. A control system as defined in claim 2, wherein said function generator emits a constant initial signal during the starting operation.

4. A control system as defined in claim 3, wherein the initial signal of said function generator has a low potential, at least during the starting operation.

5. A control system as defined in claim 1, wherein said switching means includes a signal coupling point, and the signal at said signal coupling point is dependent on the load signal as well as on the initial signal of said function generator.

6. A control system as defined in claim 2, wherein the initial signal of said function generator is at a minimum dependent on rpm.

7. A control system as defined in claim 2, wherein the initial signal of said function generator is at a minimum dependent on temperature.

8. A control system as defined in claim 2, wherein the initial signal of said function generator is at a minimum dependent on time.

* * * * *